US008398385B2

(12) United States Patent
Freiberger

(10) Patent No.: US 8,398,385 B2
(45) Date of Patent: Mar. 19, 2013

(54) REFRIGERANT COMPRESSOR

(75) Inventor: Alfred Freiberger, Grosswilfersdorf (AT)

(73) Assignee: ACC Austria GmbH, Fuerstenfeld (AT)

( * ) Notice: Subject to any disclaimer, the term of this patent is extended or adjusted under 35 U.S.C. 154(b) by 206 days.

(21) Appl. No.: 12/735,252

(22) PCT Filed: Dec. 18, 2008

(86) PCT No.: PCT/EP2008/067933

§ 371 (c)(1),
(2), (4) Date: Jun. 25, 2010

(87) PCT Pub. No.: WO2009/083481

PCT Pub. Date: Jul. 9, 2009

(65) Prior Publication Data

US 2010/0290939 A1 Nov. 18, 2010

(30) Foreign Application Priority Data

Dec. 27, 2007 (AT) ..... GM764/2007

(51) Int. Cl.
*A61M 1/00* (2006.01)

(52) U.S. Cl. ..... 417/437; 417/569; 417/571

(58) Field of Classification Search ..... 417/437, 417/559, 569–571; 29/888.02
See application file for complete search history.

(56) References Cited

U.S. PATENT DOCUMENTS

| | | | |
|---|---|---|---|
| 3,459,364 A | 8/1969 | Valbjorn et al. | |
| 4,723,896 A | 2/1988 | Fritchman | |
| 5,346,373 A | 9/1994 | Riffe | |
| 7,004,729 B2 | 2/2006 | Weber et al. | |
| 2008/0107546 A1 | 5/2008 | Falch et al. | |
| 2009/0068029 A1 | 3/2009 | Brabek et al. | |
| 2009/0136365 A1 * | 5/2009 | Zippl et al. | 417/312 |

FOREIGN PATENT DOCUMENTS

| | | |
|---|---|---|
| AT | 007 627 | 6/2005 |
| AT | 008 401 | 7/2006 |

(Continued)

OTHER PUBLICATIONS

International Search Report, Mar. 24, 2009.

*Primary Examiner* — Charles Freay
*Assistant Examiner* — Patrick Hamo
(74) *Attorney, Agent, or Firm* — Collard & Roe, P.C.

(57) ABSTRACT

Refrigerant compressor for a hermetically encapsulated small refrigerator, which has a piston (20) guided in a piston bore (3) of a cylinder housing (1), the cylinder housing being frontally terminated using a valve plate (7) having a pressure opening (17) and a suction opening (16) and also being frontally provided with holes (5), which each have a thread. In order to adapt refrigerant piston compressors having screwed-on cylinder head in such a manner that an energy-efficient redesign of the structure cylinder cover-valve plate-cylinder housing is possible, the changes on the structure required for this purpose simultaneously being minimized, it is provided that a first clamping element (11), which is screwed into the holes (5), is provided, which contacts the valve plate (7) and presses it against the cylinder housing (1) in the area of at least a section of the piston bore wall (14) and has a pre-tension in the direction of the valve plate (7) in the screwed-on state, the clamping element (11) having a clamping section (13), which is located above the piston bore wall (14) in the installed position and has the shape of an imaginary projection of the piston bore wall (14) on the first clamping element (11).

12 Claims, 15 Drawing Sheets

FOREIGN PATENT DOCUMENTS

| | | |
|---|---|---|
| DE | 38 13 539 | 11/1988 |
| DE | 44 20 865 | 12/1994 |
| WO | WO 02/095229 | 11/2002 |
| WO | WO 2006/103278 | 10/2006 |

* cited by examiner

REFRIGERANT COMPRESSOR

CROSS REFERENCE TO RELATED APPLICATIONS

This application is the National Stage of PCT/EP2008/067933 filed on Dec. 18, 2008, which claims priority under 35 U.S.C. §119 of Austrian Application No. GM 764/2007 filed on Dec. 27, 2007. The international application under PCT article 21(2) was not published in English.

AREA OF THE INVENTION

The present invention relates to a refrigerant piston compressor for a hermetically encapsulated small refrigerator, which has a piston guided in a piston bore of a cylinder housing, the cylinder housing being frontally terminated using a valve plate having a pressure opening and a suction opening and also being frontally provided with holes each having a thread, according to the preamble of Claim 1.

PRIOR ART

Various types of refrigerant piston compressors are known. The most widespread are those according to whose construction the cylinder housing having the piston bore is frontally closed using a valve plate. The valve plate, in which the suction opening for suctioning the refrigerant out of the refrigerant loop, and the pressure opening, through which the compressed refrigerant is expelled by the piston into the refrigerant loop after the compression procedure are also situated, is screwed onto the front side of the cylinder housing in these most widespread refrigerant piston compressors. For this purpose, holes are situated both on the cylinder housing and also in the valve plate, the holes in the cylinder housing each being provided with a thread, via which the screw connection is performed. On the side of the valve plate opposite to the cylinder housing, in the case of this most widespread type of refrigerant piston compressors, a cylinder cover is provided, which has a pressure chamber, in which the compressed refrigerant expelled from the cylinder is briefly temporarily stored in order to overflow into the refrigerant loop thereafter. Exemplary embodiments are also known in which a suction chamber corresponding to the pressure chamber is provided, via which the refrigerant is suctioned through the suction opening into the cylinder. Pressure chamber and suction chamber are separated from one another in such cases by appropriate structural measures in the cylinder cover. However, embodiment variants are also known in which a suction chamber is not provided in the cylinder cover and instead the refrigerant to be compressed is suctioned into the cylinder via a suction sound suppressor fastened directly on the valve plate. In both cases, however, the fastening of the cylinder cover on the cylinder housing is also performed via the same fastening screws which also fasten the valve plate on the cylinder housing, so that cylinder cover, valve plate, and cylinder housing are all connected to one another, with required seals interposed, via the same fastening screws.

However, the disadvantage has been shown in the case of the use of screw connections that because of the forces which are introduced into the cylinder housing via the fastening screws, the cylindrical shape of the cylinder bore is negatively influenced. Furthermore, the screw connections always require increased installation effort, because firstly the holes for the fastening screws must be placed in a targeted manner, in order to ensure optimum centering of the cylinder cover relative to the cylinder housing. In addition, it would be advantageous to replace the punctual contact pressure caused by the screw connections with a constant contact pressure over the entire sealing surface, whereby the sealing force is made uniform and the maximum contact pressure force is reduced.

A further problem of the widespread solution having screwed-on valve plate and screwed-on valve cover is the settling of the seals and/or the screw connection, which results in a significant loss of contact pressure force due to the rigid design of the screw connection. The screw connection force at the fastening screws must thus be multiple times greater than the required sealing force, in order to ensure permanent tightness even after the settling and at points having unfavorable force introduction. It would therefore be advantageous to press the valve plate onto the cylinder housing where the greatest loads occur due to the piston force.

Therefore, refrigerant piston compressors are also known which avoid the above-described disadvantages, in that they clamp the cylinder cover on the cylinder housing, thus, for example, from AT 7.627 U1. Simultaneously with the clamping of the cylinder cover on the cylinder housing, the interposed valve plate is also clamped on the cylinder housing in order to terminate the latter frontally and tight. The clamping causes a significantly reduced installation effort and a uniformly homogeneous, central contact pressure on the cylinder head, comprising cylinder cover and valve plate, whereby a reduction of the sealing surface is possible, but without negatively influencing the tightness.

This type of the assembly of cylinder housing, valve plate, and cylinder cover has the result that the refrigerant piston compressors constructed in this manner are clearly advantageous in relation to those first described, because they allow a complete redesign of the cylinder head, both in regard to the shape and also the material, and the described disadvantageous influences of a screw connection are avoided. However, this construction and the possibility connected thereto of the redesign of the cylinder head also predefine boundary conditions, which allow or require a redesign of the components of the refrigerant piston compressor which are directly or indirectly dependent on the cylinder head.

The desire often exists in practice, however, to adapt refrigerant piston compressors having screwed-on cylinder head already in use, so that at least the described problems which occur in connection with the settling of the seals are avoided. The implementation of the already known solution having clamped cylinder cover is either not possible at all or is at least not economically feasible in such cases, however.

An example of this is also shown in U.S. Pat. No. 3,459,364, which also discloses a refrigerant compressor in which the cylinder head is clamped against the cylinder housing clamping elements. As is immediately obvious, an implementation of such a solution in the first-described group of refrigerant compressors having screwed-on cylinder head is not possible, notwithstanding the inadequate quality of the clamping connected to this solution.

WO 2006/103278 A discloses a cylinder head configuration, in which the pressure channel and the suction channel are pressed against the valve plate by a clamping element. Screws are used to fasten the valve plate on the cylinder housing. A local, very-limited contact pressure of the valve plate on the piston bore wall occurs (the boundary area of a clamping element implemented in the form of an inverted "Y" intersects the piston bore twice in approximately the radial direction).

It is the object of the present invention to adapt refrigerant piston compressors having screwed-on cylinder head so that an energy-efficient redesign of the structure cylinder cover-valve plate-cylinder housing is possible, the changes on the structure required for this purpose simultaneously being minimized.

It is a further object of the present invention to adapt known refrigerant piston compressors having screwed-on cylinder head so that the occurrence of settling at the seals can be compensated for.

DESCRIPTION OF THE INVENTION

It is provided according to the invention that in the case of a refrigerant piston compressor for a hermetically encapsulated small refrigerator, which has a piston guided in a piston bore of a cylinder housing and in which the cylinder housing is frontally terminated using a valve plate having a pressure opening and a suction opening and is also frontally provided with holes each having a thread, a first clamping element screwed into the holes is provided, which contacts the valve plate and presses it against the cylinder housing in the area of at least a section of the piston bore wall and has a pre-tension in the direction of the valve plate in the screwed-on state, the first clamping element having a clamping section which is located above the piston bore wall in the installed position and which has the shape of an imaginary projection of the piston bore wall on the first clamping element.

In this way, typical refrigerant piston compressors, in which the valve plate is screwed onto the cylinder housing, may be adapted accordingly, in that the typical valve plate is replaced with a new one, which is pressed by the clamping element according to the invention against the cylinder housing in the area of the piston bore wall. In other words, typical refrigerant piston compressors may be easily and rapidly adapted by replacing the valve plate, without changes having to be performed on the fundamental construction of the cylinder housing. In addition, in contrast to a typical screw connection, the clamping element is capable of compensating for settling of the seal between valve plate and cylinder housing because of the pre-tension, whereby the maximum contact pressure force can also be reduced.

In a preferred embodiment variant of the invention, it is provided that the valve plate is implemented as round. In contrast to typical refrigerant piston compressors, material can thus be saved, in that the valve plate is only manufactured slightly larger than the piston bore and thus no longer covers the entirety or a majority of the front side of the cylinder housing. Advantages thus also result in the case of the heat transfer, because less heat can be transferred from the hot cylinder housing to the valve plate and thus less heat can be transferred to the sucked-in refrigerant, whereby the energy efficiency of the piston compressor is increased.

According to a further preferred embodiment variant of the invention, it is provided that the valve plate has positioning arms, which at least partially encompass fastening screws screwed into the holes. Because the fastening screws are retained as an important component of the adaptation of typical refrigerant compressors and are used as the fastening means for the first clamping element according to the invention, the fastening screws may be used as orientation elements by providing the positioning arms.

Alternatively thereto, according to the features of Claims 4 and 5, the exact positioning of the valve plate can also be performed via the cylinder housing or the clamping element itself. This can be achieved, for example, by a recess in the cylinder housing or the first clamping element, whose outline in a plane perpendicular to the axis of the cylinder housing essentially corresponds to the outline of the valve plate and whose depth preferably corresponds to the thickness of the valve plate. Centering can also be performed via centering pins provided on the first clamping element, which engage in corresponding centering holes on the valve plate and thus center the valve plate.

A further embodiment variant of the invention provides that the first clamping element, in the screwed-on position, has at least one, preferably round release area within the imaginary projection of the piston bore wall on the clamping element. This at least one release area is required to connect components of the suction and/or pressure lines to the suction opening or pressure opening in the valve plate, in order to be able to convey refrigerant into or out of the cylinder.

According to an additional embodiment variant of the invention, a second clamping element screwed into the holes is provided, which clamps components of the suction and/or pressure lines, which are positioned in the at least one release area, against the valve plate. In this way, not only is the valve plate clamped against the cylinder housing, but rather also the components of the suction and/or pressure lines. The typical valve cover can thus also be replaced by more efficient components.

In a further embodiment variant of the invention, it is provided that the components of the suction and pressure lines have depressions on their side facing toward the clamping element, which jointly correspond in their outlines to at least one section of the outline of the second clamping element. Slipping of the second clamping element can thus be prevented and the steady maintenance of the clamping force can be ensured.

In a particularly preferred embodiment variant of the invention, first clamping element and second clamping element are manufactured in one piece, whereby particularly simple installation is possible. In this case, the clamping element has passages, which allow the supply and removal for the suction and pressure lines. The clamping force is introduced into the valve plate at these points for the passages indirectly via the suction or pressure line components.

BRIEF DESCRIPTION OF THE FIGURES

The invention is described in greater detail hereafter on the basis of an exemplary embodiment. In the figures.

WAYS OF IMPLEMENTING THE INVENTION

Figure 1:
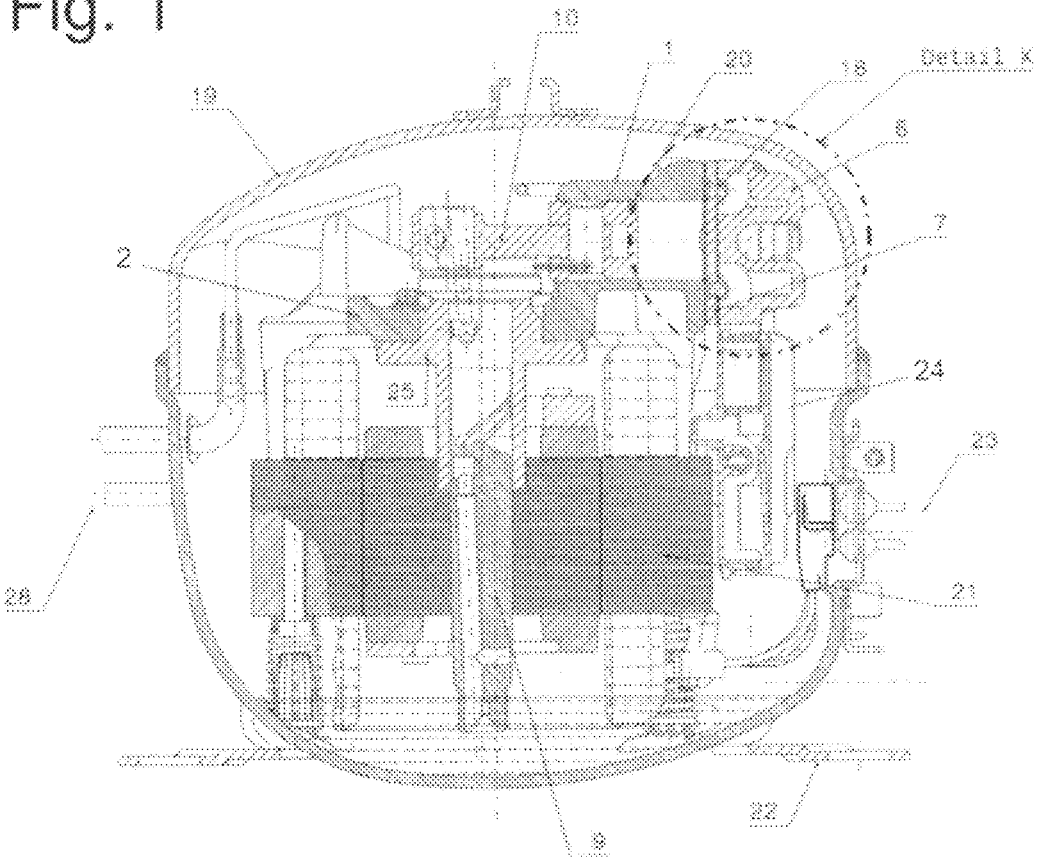
FIG. 1 shows a sectional view of a refrigerant piston compressor according to the prior art

FIG. 1 shows a sectional view of a refrigerant piston compressor according to the prior art. A cylinder housing 1 including crankshaft bearing receptacle 2, crankshaft bearing 25, crankshaft 9, connecting rod 10, and piston 20 are situated in a two-part, hermetically sealed housing 19. The crankshaft 9 is driven via an electric motor 21. Furthermore, feet 22, an electrical connection unit 23, and refrigerant lines 28 leading into or out of the housing 19 are obvious in FIG. 1, via which refrigerant is conveyed away from the cylinder housing 1 or to the suction sound suppressor 24 leading to the cylinder housing 1.

Figure 2:
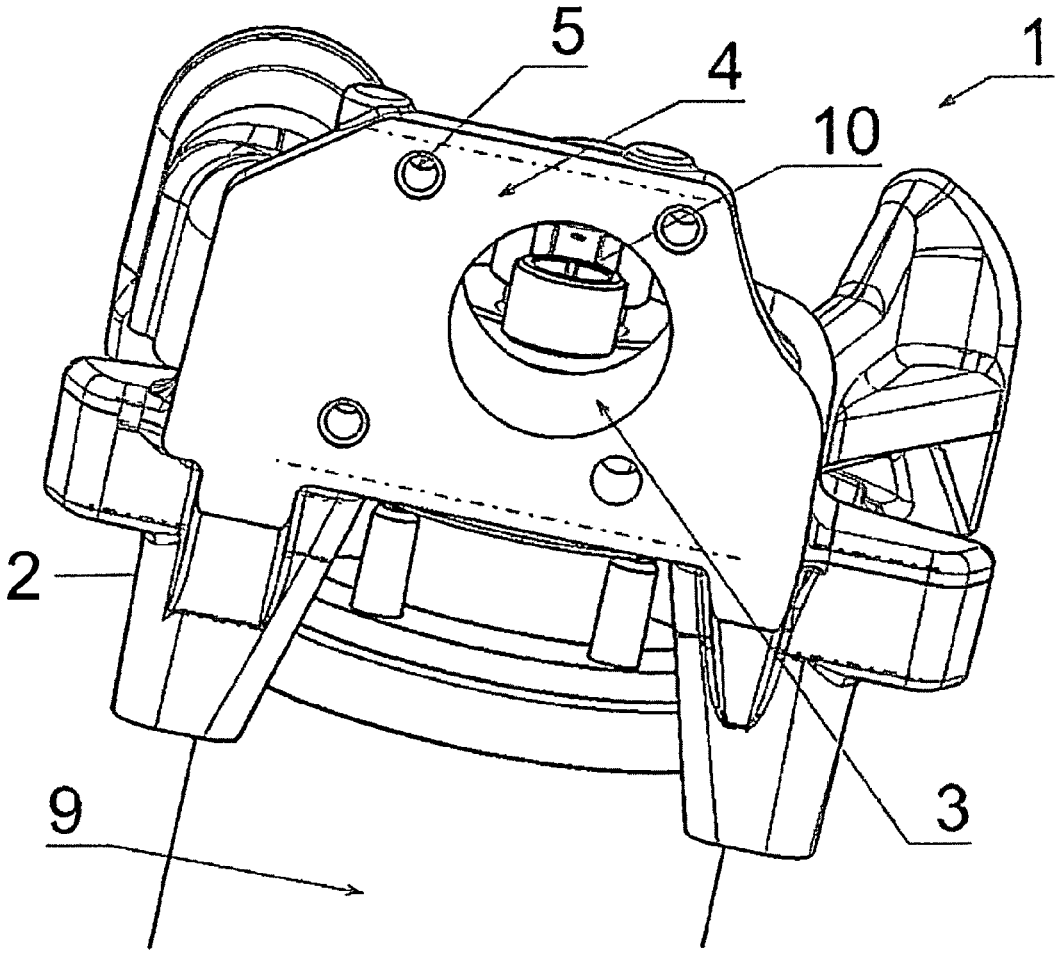
FIG. 2 shows an axonometric view of a cylinder housing with crankshaft bearing receptacle without cylinder head (detail X from FIG. 1)

FIG. 2 shows an axonometric view of detail X from FIG. 1 of the cylinder housing 1 with crankshaft bearing receptacle 2, but without cylinder head according to the prior art. The cylinder housing 1 is provided with a piston bore 3 and has four threaded holes 5 on a front side 4. These are used in known refrigerant piston compressors according to the species for screwing the cylinder head, comprising cylinder cover 6 and valve plate 7 (not shown in FIG. 2) onto the cylinder housing 1 by fastening screws 18, as is obvious from FIG. 1. The piston 20 guided in the piston bore 3 is also not shown in FIG. 2 for reasons of clarity.

Figure 3:
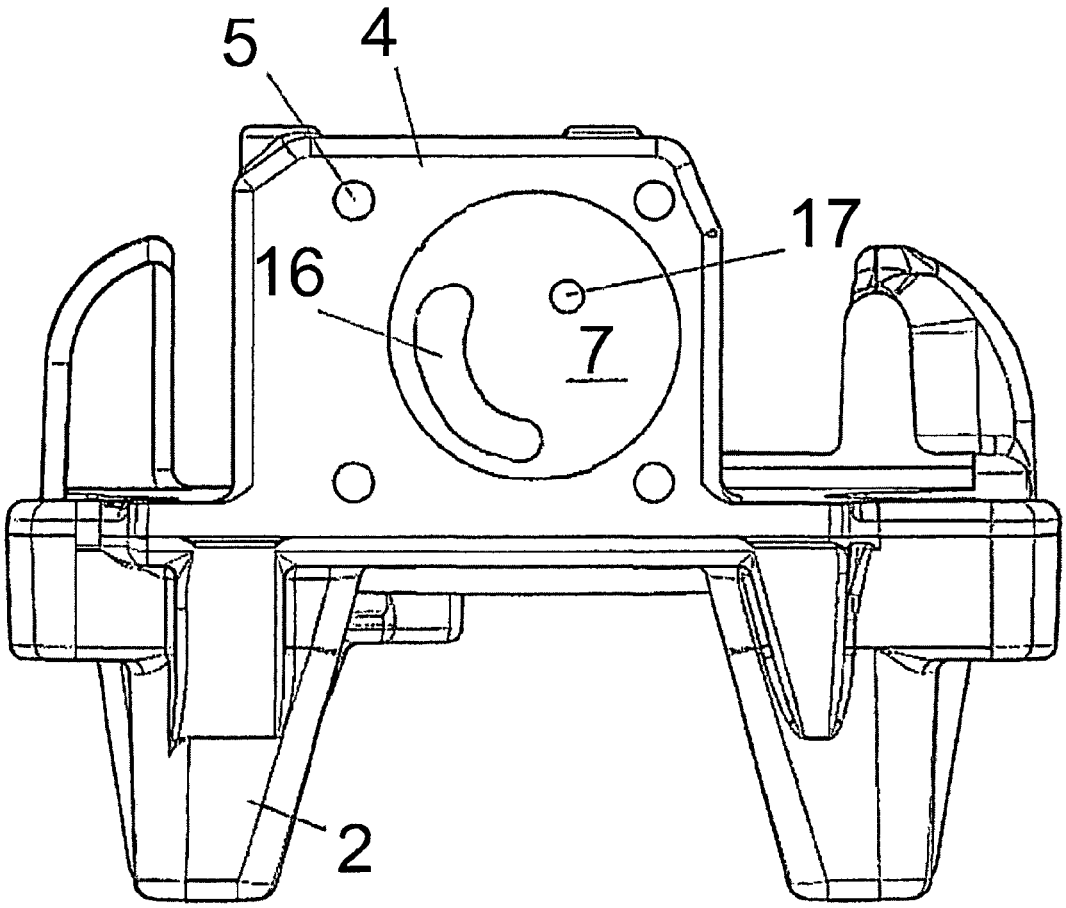
FIG. 3 shows a frontal view of the front side of the cylinder housing having valve plate according to the invention
Figure 4:
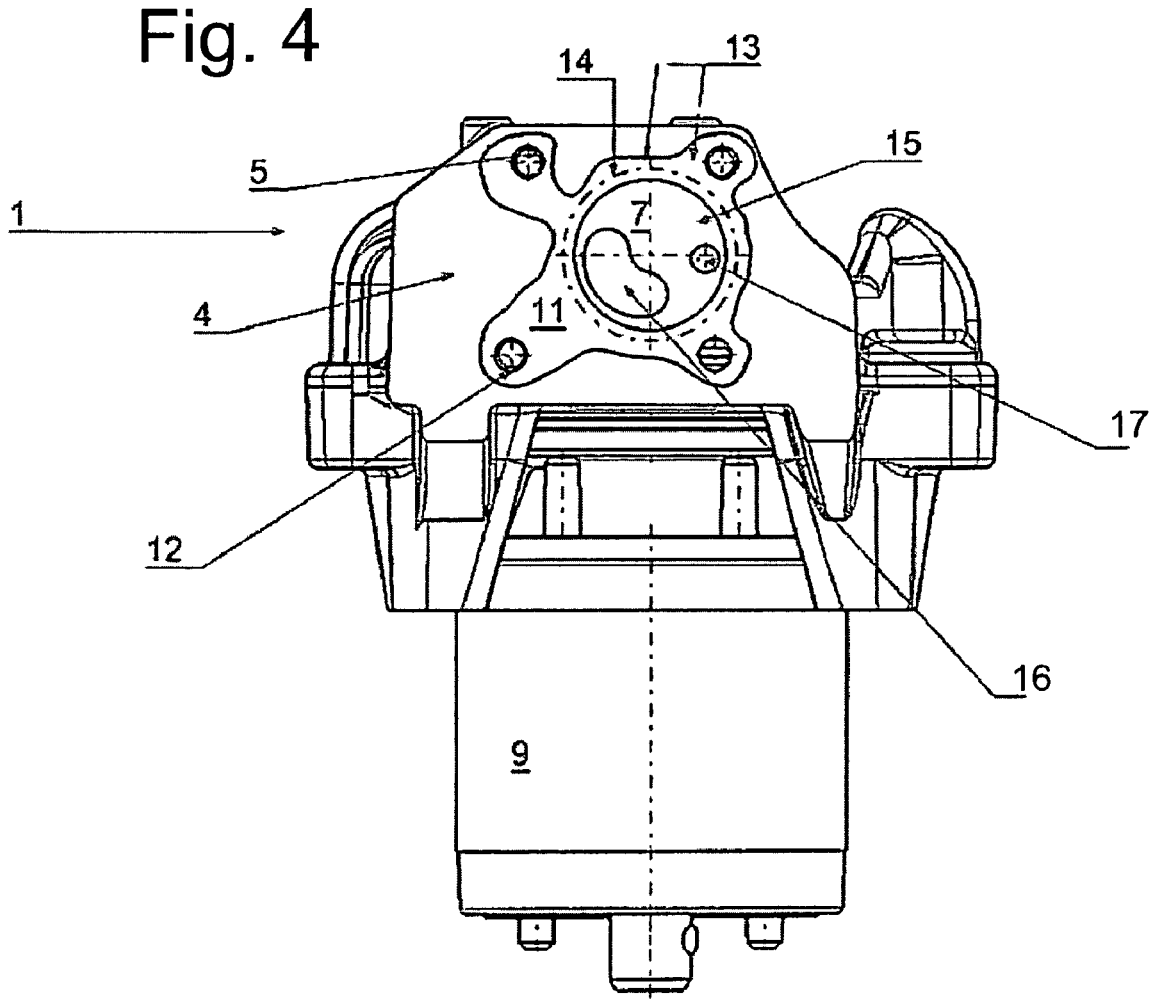
FIG. 4 shows a detail view of the front side of the cylinder housing having valve plate according to the invention and first clamping element

FIG. 3 shows a frontal view of the cylinder housing 1 of a refrigerant compressor according to the invention. The front side 4 of the cylinder housing 1 corresponds to the front side 4 from FIG. 2, i.e., a known refrigerant compressor. In contrast to the latter, however, according to the invention a valve plate 7 is provided, which is not fastened on the cylinder housing 1 using the fastening screws 18. Instead, the fastening of the valve plate 7 on the cylinder housing 1 is performed using a first clamping element 11, as is obvious from FIG. 4. According to the invention, the valve plate 7 no longer flatly covers the entirety or the majority of the front side 4, but rather only the area required for the seal. The valve plate 7 preferably covers the piston wall 3 only slightly because of its dimensions, the valve plate 7 preferably being implemented as round.

In order to produce the required tightness in relation to the interior of the cylinder housing 1, the valve plate 7 must be pressed against the front side 4 using sufficient contact pressure. According to the invention, this is performed by the first damping element 11, which is not in contact with the refrigerant, and which is screwed onto the cylinder housing 1 via the threaded holes 5 using fastening screws 18 (not shown in FIG. 4).

The first clamping element 11 has fastening arms 12 for this purpose, which are used for receiving the fastening screws 18, and a clamping section 13. This clamping section is located above the piston bore wall 14 in the installed position and has the shape of an imaginary projection of the piston bore wall 14 on the first clamping element 11. Within this imaginary projection of the piston bore wall 14 on the first clamping element 11, it has an release area 15, which is preferably but not necessarily also implemented as round and concentric to the piston bore wall 14 and which makes a suction opening 16 and pressure opening 17 situated in the valve plate 7 accessible. A pressure is exerted on the valve plate 7 by the clamping element 11 according to the invention exactly in the area of the piston bore wall 14, whereby a particularly exact fastening capability of the valve plate 7, which is insensitive to settling of a seal (not shown separately) situated between valve plate 7 and cylinder housing 1, is provided. According to the invention, the clamping section can also be designed so that the valve plate 7 is only pressed against the cylinder housing 1 in the area of a section of the piston bore wall 14.

The fastening according to the invention using first clamping element 11 can be improved in that according to a preferred embodiment variant of the invention, the first clamping element has a pre-tension which is directed against the valve plate 7 in the screwed-on state.

Figure 5:
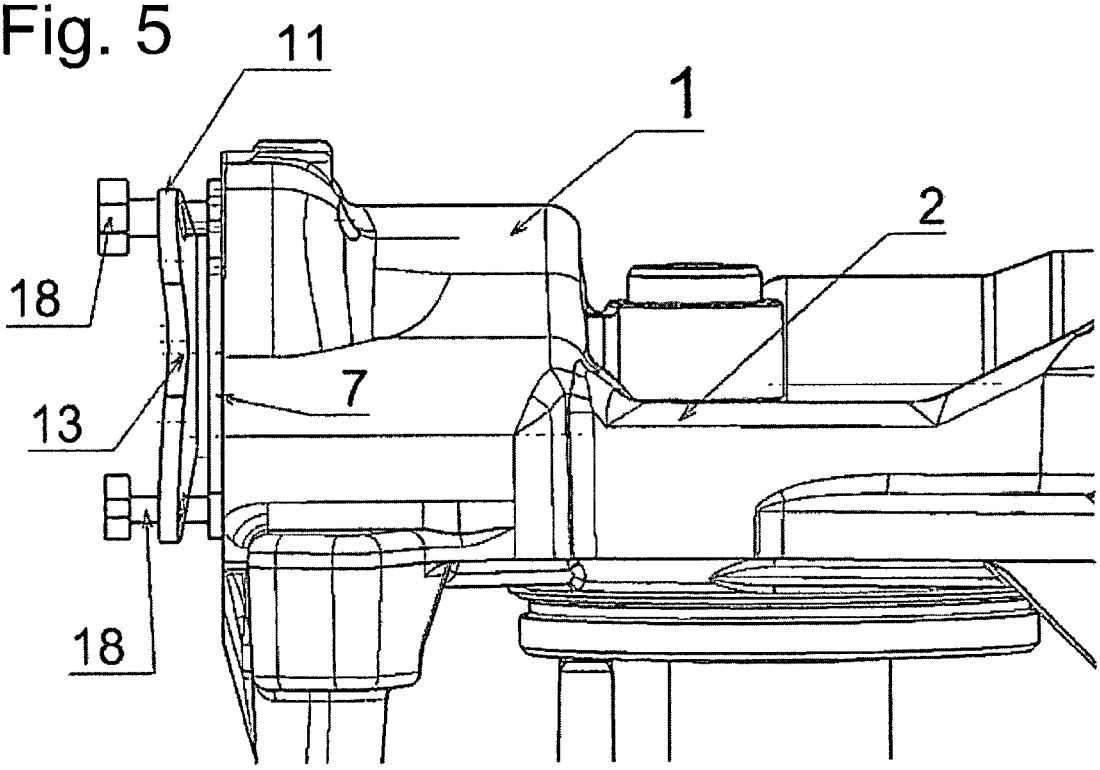
FIG. 5 shows a side view of a cylinder housing according to the invention having first clamping element
Figure 6:
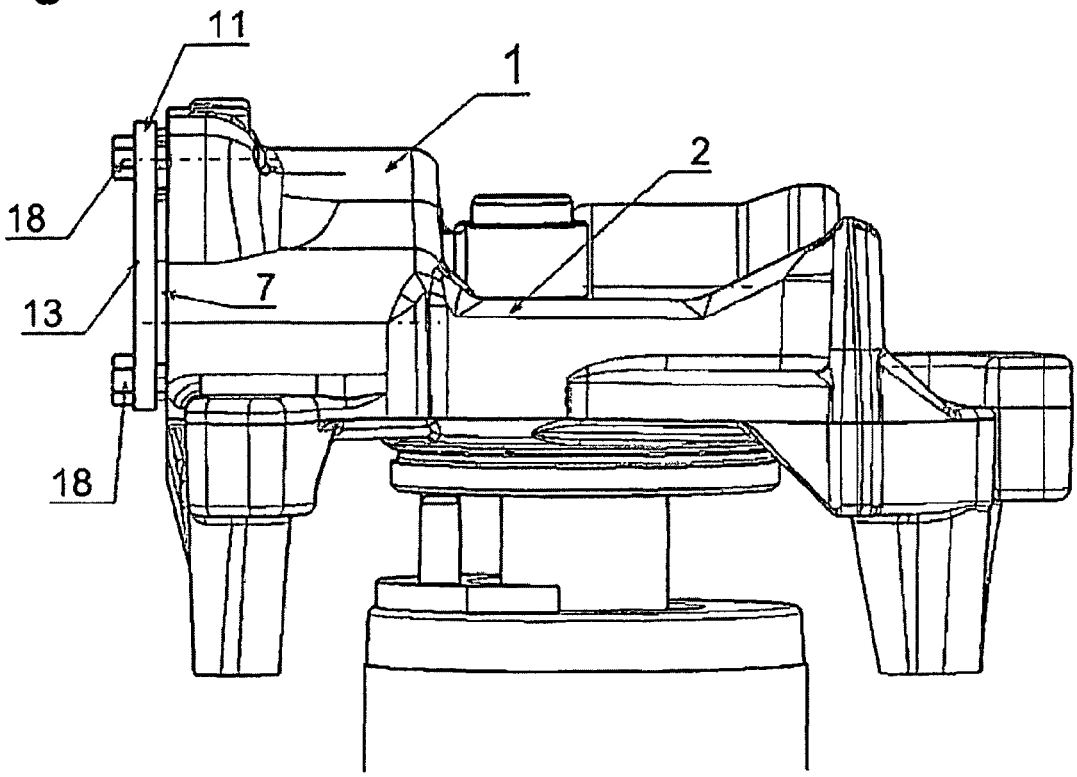
FIG. 6 shows a side view of a cylinder housing according to the invention having first clamping element in pre-tensioned state

FIG. 5 shows a side view of a cylinder housing 1 according to the invention, having first clamping element 11 in a position shortly before the fastening screws 18 are screwed on. The clamping section 13 curved in the direction of the valve plate 7 is very well recognizable, which causes the pre-tension on the valve plate 7 after the fastening screws 18 are tightened, as is obvious from FIG. 6. In order to ensure particularly good pre-tension properties of the first clamping element, it is preferably manufactured from stamped steel.

Figure 7:
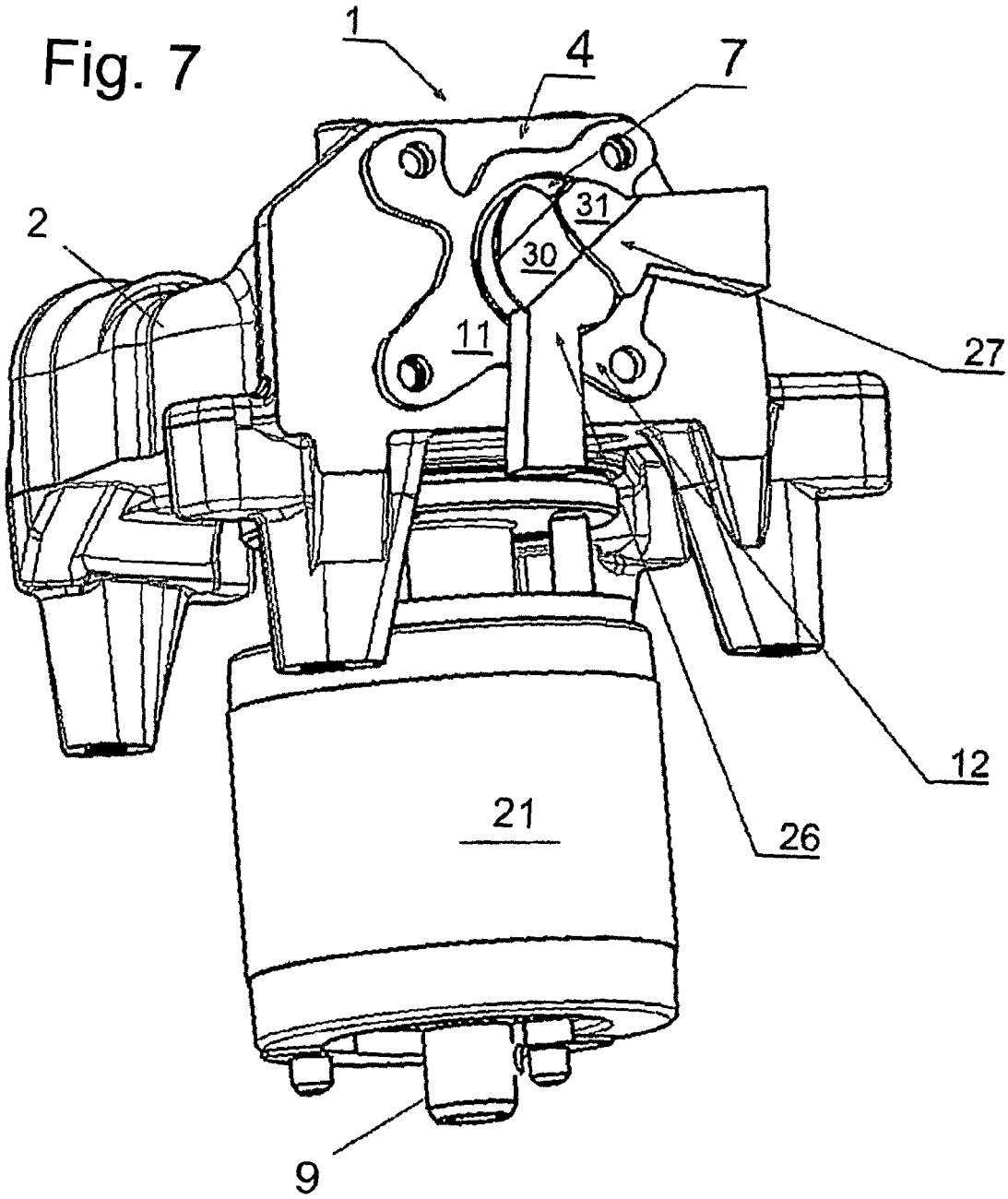
FIG. 7 shows a detail view of the front side of the cylinder housing having pressure and suction line components according to the invention

As already noted, the valve plate 7 has a suction opening 16 and a pressure opening 17, via which refrigerant is sucked into the cylinder or expelled therefrom. The attachment is performed according to a particularly preferred embodiment variant of the invention using components 26, 27 integrated in the suction line or pressure line of the refrigerant, which may also be implemented in one piece. FIG. 7 shows an exemplary embodiment of the components 26, 27. They are manufactured and shaped in accordance with the requirements of an energy-efficient refrigerant exchange with the cylinder and may have various appearances. The suction line component 26 is typically connected to the suction sound suppressor 24 (not shown in FIG. 7), via which refrigerant is suctioned from the vaporizer of the refrigerant loop into the cylinder. The pressure line component 27 is typically connected to refrigerant lines 28 (not shown in FIG. 7) leading out of the housing 18, which are connected to the evaporator of the refrigerant loop.

Figure 8:
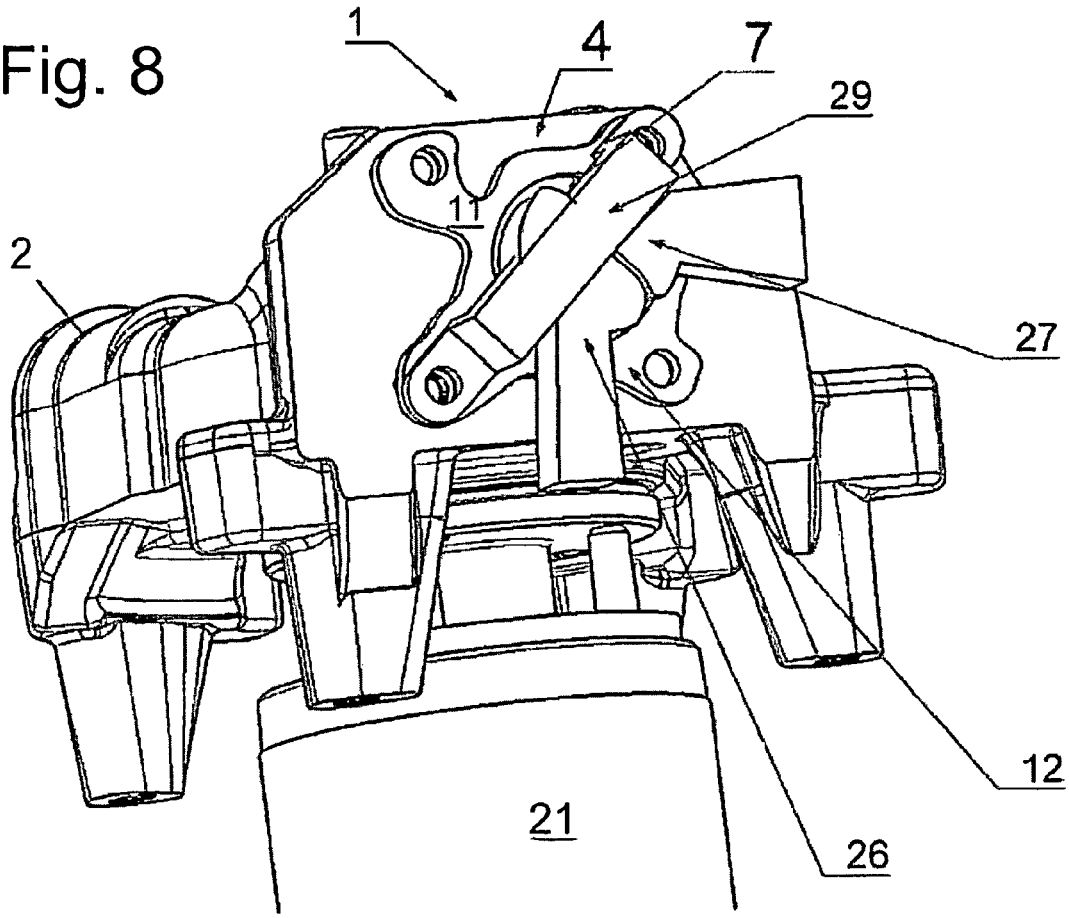
FIG. 8 shows a detail view of the front side of the cylinder housing having pressure and suction line components and second clamping element according to the invention

The fastening of the components 26, 27, which are integrated in the suction line or pressure line, to the valve plate 7 is performed in a preferred embodiment variant of the invention using a second clamping element 29 (see FIG. 8), which can also have a pre-tension corresponding to the first clamping element 11. The second clamping element 29 is also screwed onto the cylinder housing 1 using fastening screws 19 like the first clamping element 11.

In order to ensure a defined clamping area on the components 26, 27 integrated in the suction line or pressure line, which cannot be shifted because of the pressure variations in the suction or pressure line occurring as a result of the oscillating piston, both suction line component 26 and also pressure line component 27 have depressions 30, 31 on their surface facing toward the second clamping element 29, which correspond jointly in their outlines to at least one section of the outline of the second clamping element 29. Slipping of the clamping element or shifting of the active area of the clamping force which is caused by vibrations can thus be prevented.

The positioning of the components 26 and 27, which may also be implemented in one piece, can be performed on the first clamping element 11, on the second clamping element 29, or on the valve plate 7. A seal is preferably to be provided for better sealing between the valve plate and the two components 26 and 27. In the case of appropriate design of the components 26 and 27 and the valve plate and/or in the case of selection of appropriate materials, this seal can also be dispensed with.

Figure 9:
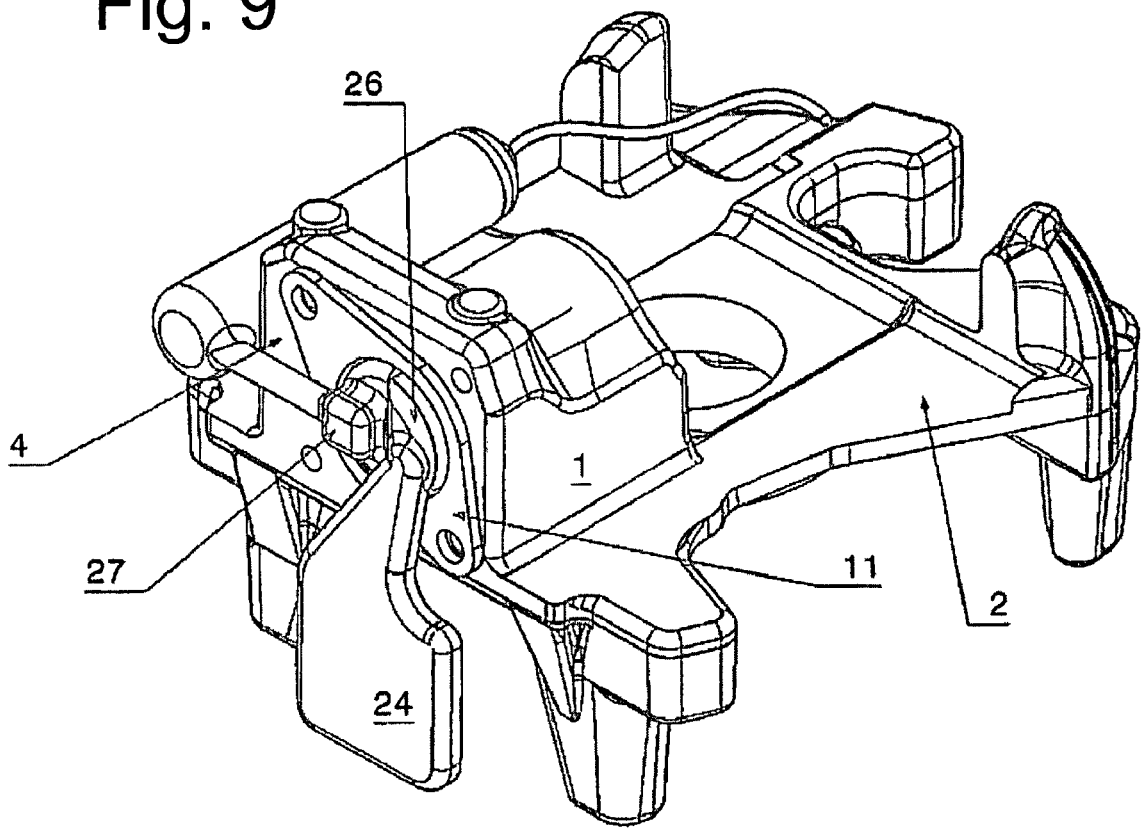
FIG. 9 shows an axonometric view of a cylinder housing with crankshaft bearing receptacle and cylinder head without second clamping element
Figure 10:
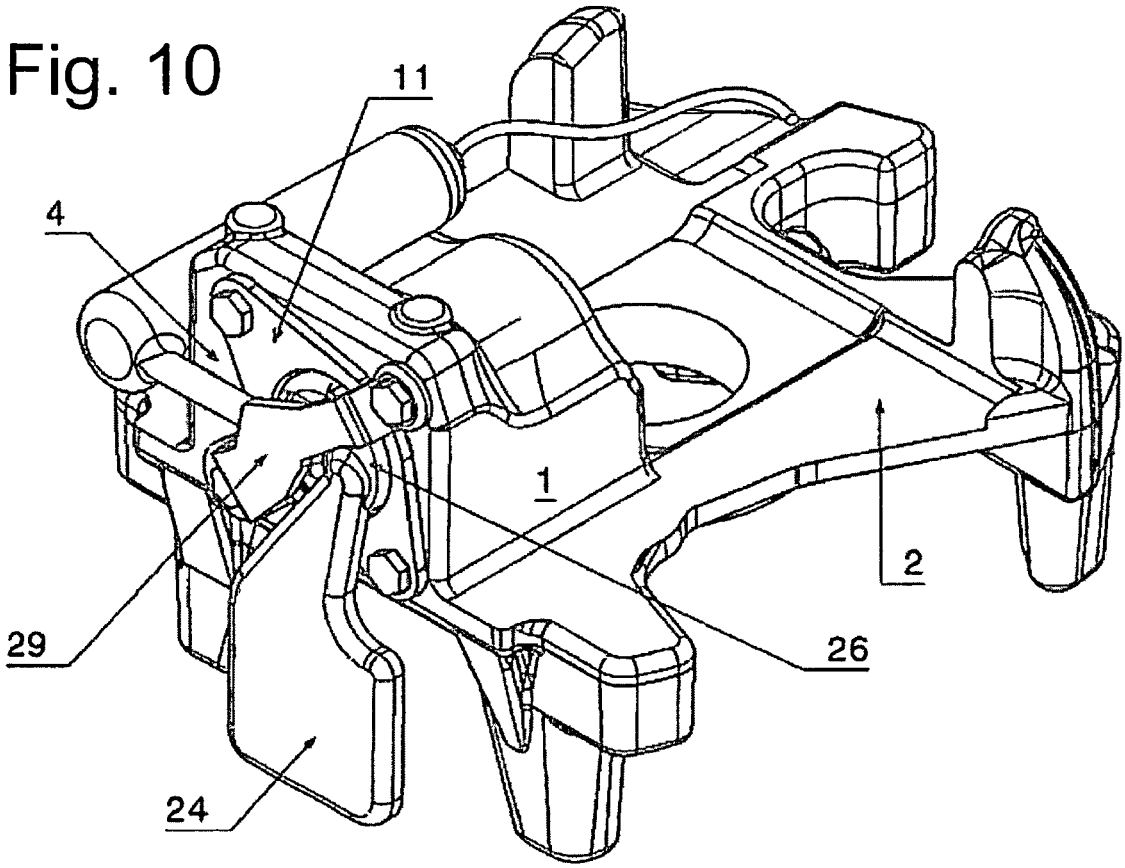
FIG. 10 shows an axonometric view of a cylinder housing with crankshaft bearing receptacle and cylinder head with second clamping element

FIG. 9 shows an axonometric view of a cylinder housing 1 with crankshaft bearing receptacle 2 and cylinder head, comprising valve plate 7 and suction and pressure line components 26, 27. However, a second clamping element 29, in order to fasten the suction and pressure line components 26, 27 on the valve plate 7, is not shown in FIG. 9 for reasons of clarity. This is obvious in FIG. 10.

Figure 11:
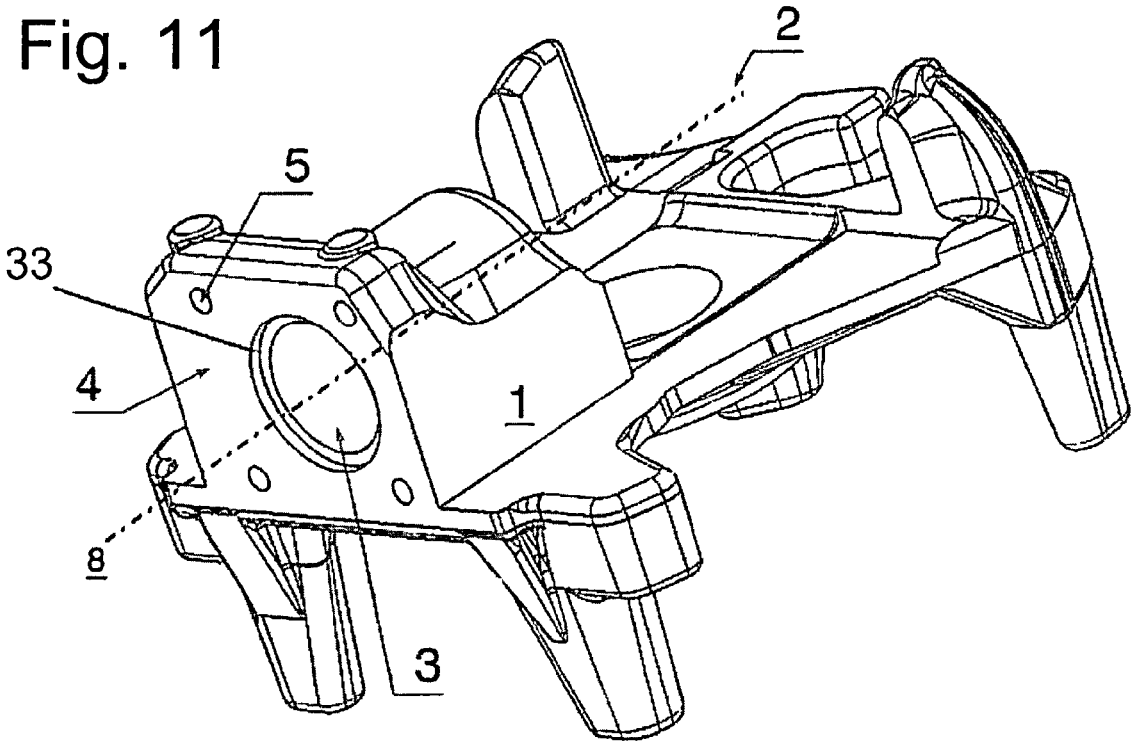
FIG. 11 shows an axonometric view of a cylinder housing having recess with crankshaft bearing receptacle

In order to achieve exact positioning of the valve plate 7 on the cylinder housing 1 or more precisely on the front side 4 of the cylinder housing 1, positioning aids are preferably provided. FIG. 11 shows a positioning aid implemented as a recess 33 in the front side 4 of the cylinder housing 1. The outline of the recess 33 in a plane perpendicular to the axis of the cylinder housing 1 essentially corresponds to the outline of the valve plate 7 and the depth of the recess 33 preferably essentially corresponds to the thickness of the valve plate 7 plus any provided seals. The valve plate 7 can thus be completely countersunk in the cylinder housing 1, whereby a particularly optimized possibility for the sealing results.

Figure 12:
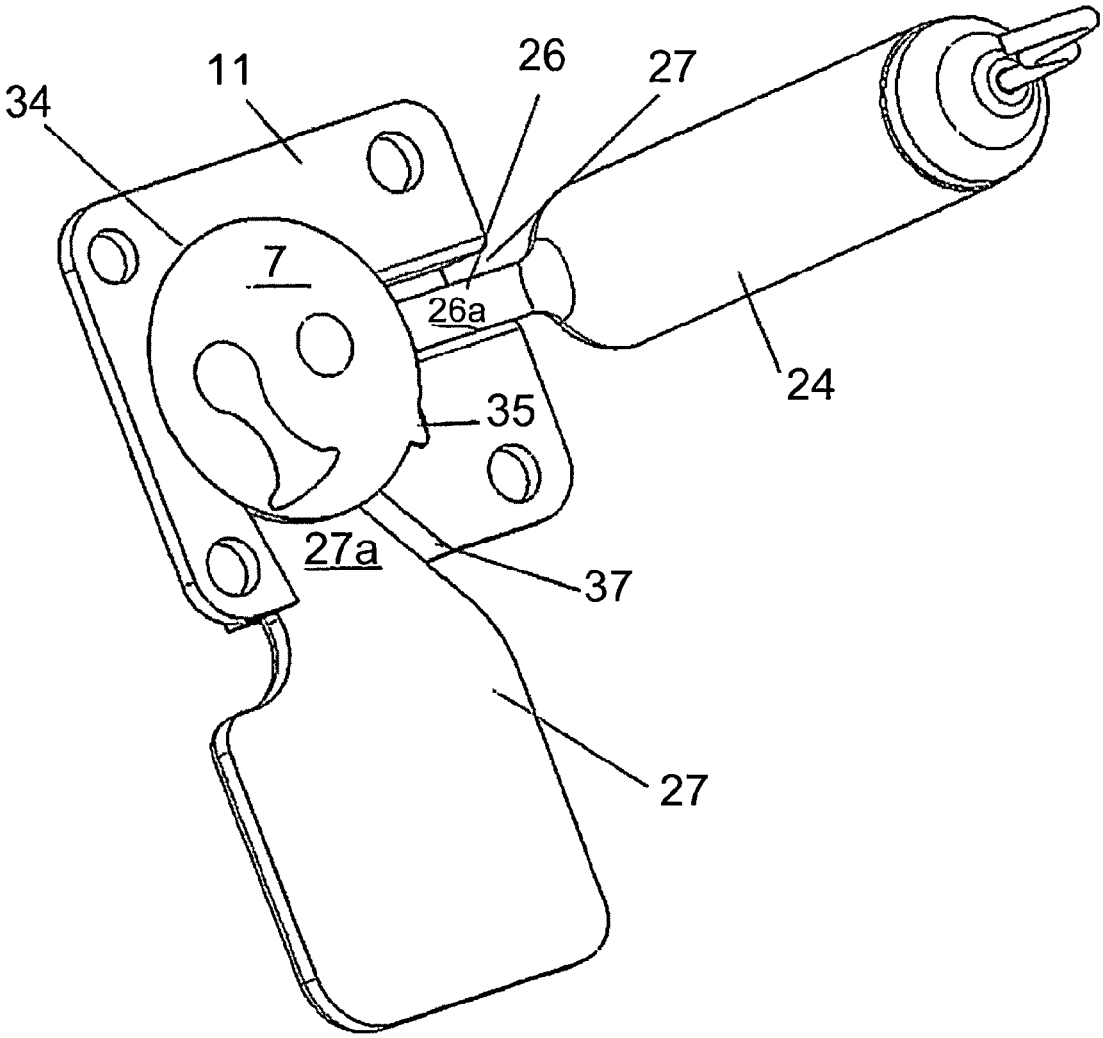
FIG. 12 shows an axonometric view of a first clamping element having recess

FIG. 12 shows an axonometric bottom view of the first clamping element 11 including pressure line component 27 and suction line component 26, which is connected to the suction sound suppressor 24. Pressure line component 27 and suction line component 26 are manufactured in one piece in this exemplary embodiment. In contrast to FIG. 11, where the recess 33 implemented as a positioning aid is situated in the front face 4 of the cylinder housing 1, in the case of the exemplary embodiment according to FIG. 12, a recess 34 implemented as a positioning aid is situated on the bottom side of the first clamping element 11, so that the valve plate 7 can be completely countersunk into the first clamping element 11. For the case in which the attachment of the suction line component 26 and the pressure line component 27 on the valve plate 7 is inadequate for sufficient location stability of the valve plate 7, a positioning extension 35 can additionally be provided on the valve plate 7, which engages in a corresponding opening of the recess 33 (not shown in FIG. 11) or recess 34 (FIG. 12), in order to prevent pivoting of the valve plate 7. Of course, the positioning extension 35 can also be situated in the recess 33 or 34 and the corresponding openings in the valve plate 7.

Figure 13:
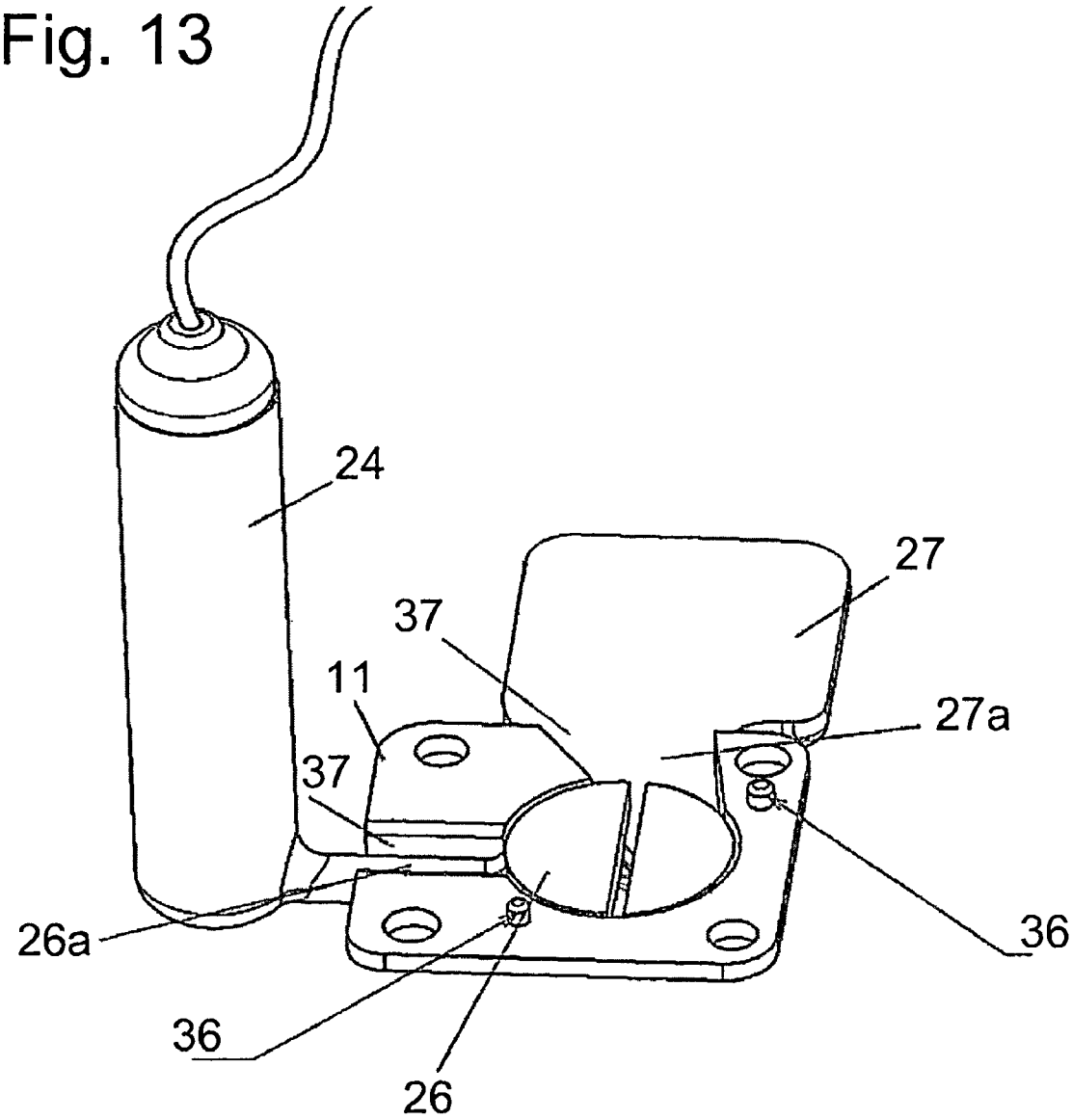
FIG. 13 shows an axonometric view of a first clamping element having positioning pins
Figure 14:
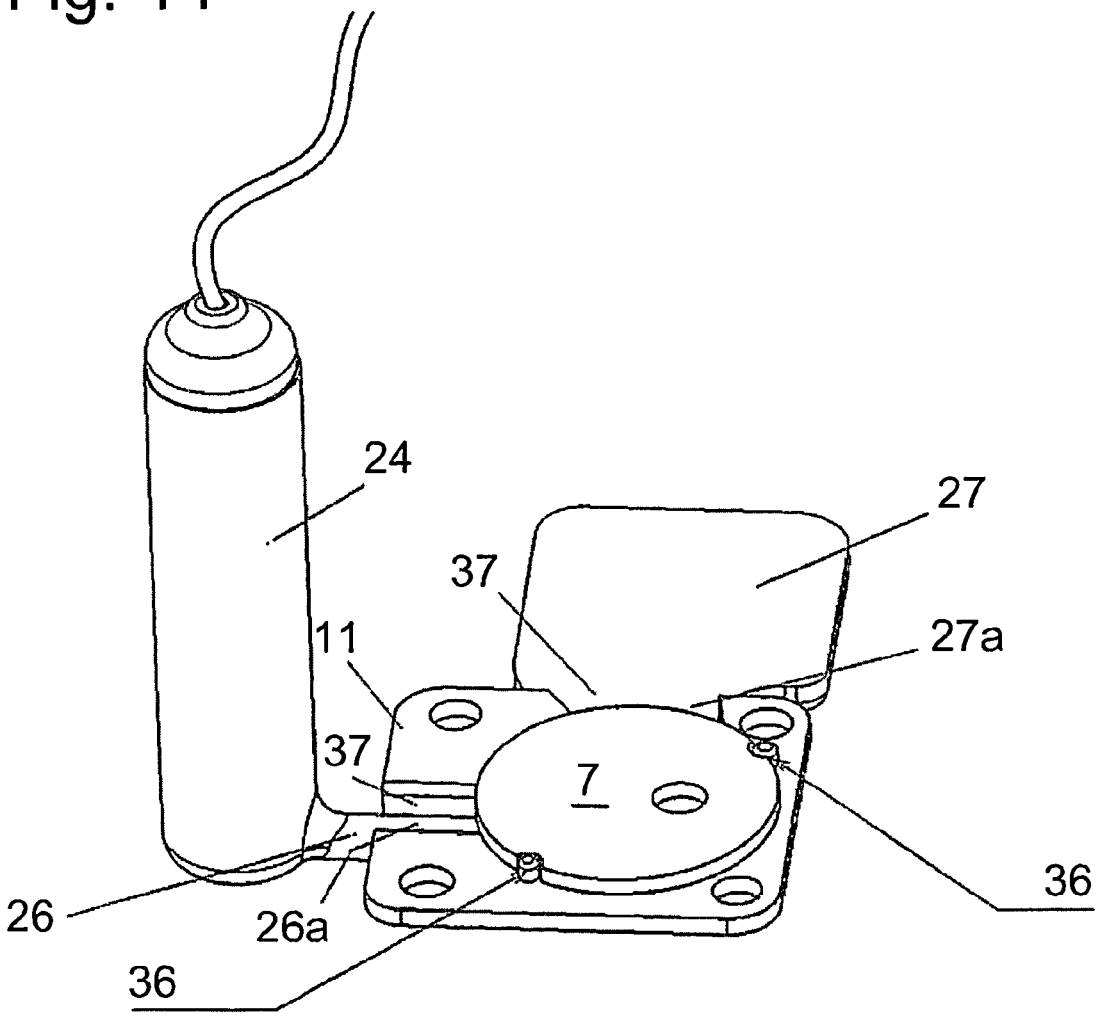
FIG. 14 shows an axonometric view of a first clamping element having positioning pins and valve plate

FIG. 13 shows a further alternative embodiment variant of a positioning aid, which is implemented in this case as the positioning pins 36, which protrude from the bottom side of the first clamping element 11 in the direction of the cylinder housing 1 and engage in corresponding positioning openings of the valve plate 7, as shown in FIG. 14. It is obvious that the positioning pins 36 may also protrude from the front face 4 of the cylinder housing in the direction of the first clamping element 11 in order to achieve the same positioning effect.

Figure 15:
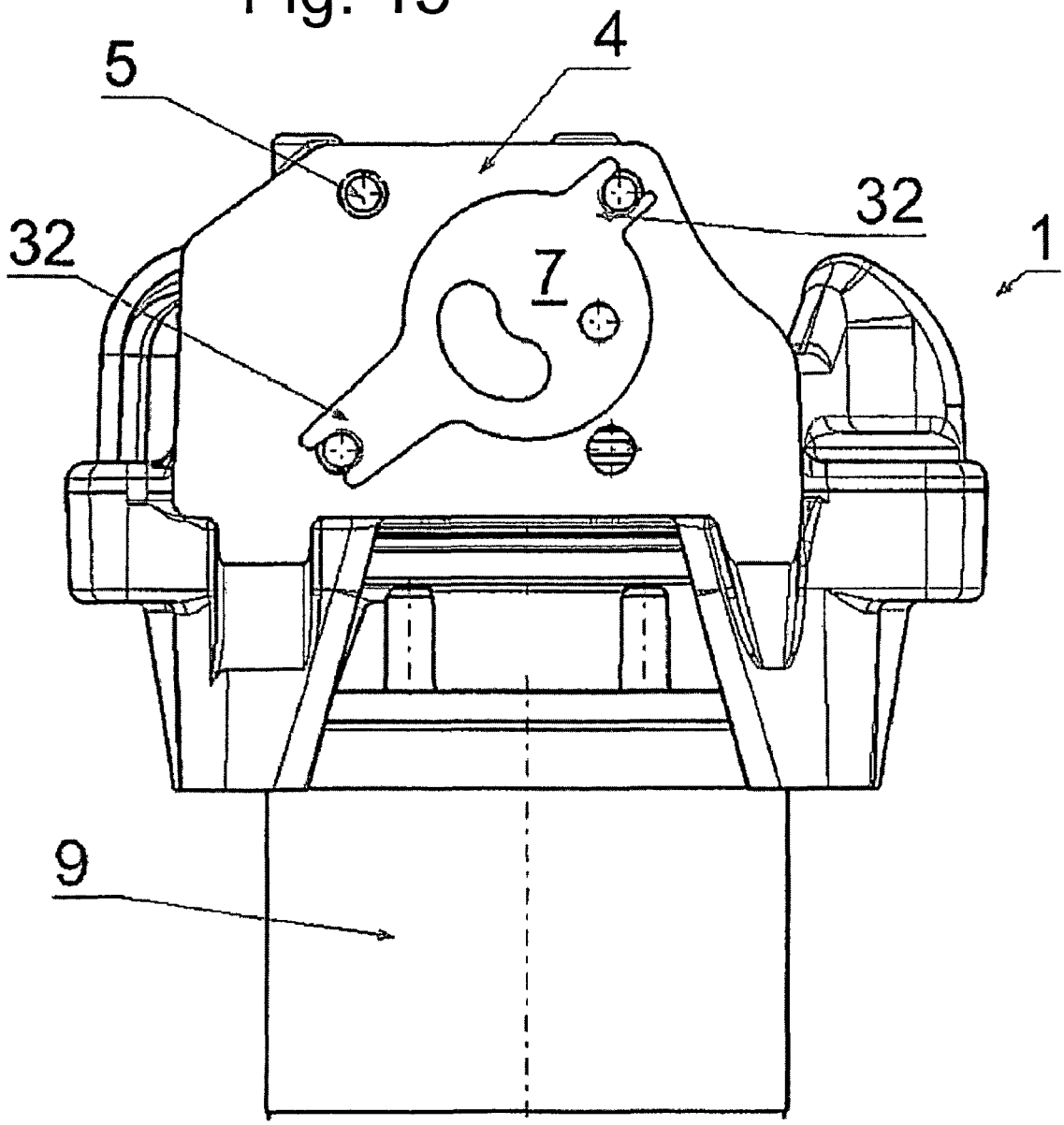
FIG. 15 shows a frontal view of an embodiment variant of a valve plate according to the invention

FIG. 15 shows a further embodiment variant of a positioning aid. The valve plate 7 has positioning arms 32, which encompass the threaded holes 5. An orientation on the fastening screws 18 screwed into the threaded holes 5 is thus possible.

For the case of a one-piece embodiment variant of first clamping element 11 and second clamping element 29, as shown in FIGS. 12 to 14 (second clamping element 29 not visible), it is provided that the first clamping element 11 has passages 37, through which sections 26*a*, 27*a* of the suction line components 26 and pressure line components 27 are guided. The clamping force from the second clamping element 29 is transmitted indirectly at these points via the sections 26*a*, 27*a* into the valve plate 7.

LIST OF REFERENCE NUMERALS

1 cylinder housing
2 crankshaft bearing receptacle
3 piston bore
4 front side
5 threaded holes
6 cylinder cover
7 valve plate
8 piston bore axis
9 crankshaft
10 connecting rod
11 first clamping element
12 fastening arms
13 clamping section
14 piston bore wall
15 release area
16 suction opening
17 pressure opening
18 fastening screws
19 housing
20 piston
21 electric motor
22 feet
23 electrical connection unit
24 suction sound suppressor
25 crankshaft bearing
26 suction line component
26*a* section of the suction line component
27 pressure line component
27*a* section of the pressure line component
28 refrigerant lines
29 second clamping element
30 depression in the suction line component
31 depression in the pressure line component
32 positioning arms
33 recess in the cylinder housing
34 recess in the first clamping element
35 positioning extension
36 positioning pins
37 passages

The invention claimed is:

1. A refrigerant compressor for a hermetically encapsulated small refrigerator, which has a piston (20) guided in a piston bore (3) of a cylinder housing (1), the cylinder housing being frontally terminated using a valve plate (7) having a pressure opening (17) and a suction opening (16) and also being frontally provided with holes (5) each having a thread, wherein a first clamping element (11), which is screwed into the holes (5), is provided, which contacts the valve plate (7) and presses it against the cylinder housing (1) in the area of at least a section of the piston bore wall (14) and has a pretension in the direction of the valve plate (7) in the screwed-on state, the first clamping element (11) having a clamping section (13), which is located above the piston bore wall (14) in the installed position and has the shape of an imaginary projection of the piston bore wall (14) on the first clamping element (11).

2. The refrigerant compressor according to claim 1, wherein the valve plate (7) is implemented as round.

3. The refrigerant compressor according to claim 1, wherein the valve plate (7) has positioning arms (32), which at least partially encompass fastening screws (18) screwed into the holes.

4. The refrigerant compressor according to claim 1, wherein the cylinder housing (1) or the first clamping element (11) has a recess (33), whose outline in a plane perpendicular to the axis of the cylinder housing (1) essentially corresponds to the outline of the valve plate (7), its depth preferably essentially corresponding to the thickness of the valve plate (7).

5. The refrigerant compressor according to claim 1, wherein positioning pins (36) are provided on the first clamping element (11), which engage in corresponding positioning openings situated on the valve plate (7).

6. The refrigerant compressor according to claim 1, wherein positioning pins (36) are provided on the cylinder housing (1), which engage in corresponding positioning openings situated on the valve plate (7).

7. The refrigerant compressor according to claim 1, wherein the first clamping element (11) has at least one, preferably round release area (15) within the imaginary projection of the piston bore wall (14) on the clamping element (11).

8. The refrigerant compressor according to claim 7, wherein a second clamping element (29) screwed into the holes is provided, which clamps components (26, 27) of the suction and/or pressure line, which are positioned in the at least one release area (15), against the valve plate (7).

9. The refrigerant compressor according to claim 8, wherein the components (26, 27) of the suction and pressure lines have depressions (30, 31) on their side facing toward the second clamping element (29), which jointly correspond in their outlines to at least the section of the outline of the second clamping element (29).

10. The refrigerant piston compressor according to claim 8, wherein first clamping element (11) and second clamping element (29) are manufactured in one piece.

11. The refrigerant compressor according to claim 8, wherein the first clamping element (11) has passages (37), through which the suction line component (26) and the pressure line component (27) are guided to the suction openings (16) or to the pressure opening (17) of the valve plate (7).

12. The refrigerant compressor according to claim 8, wherein the cross-section of the suction line component (26) and the pressure line component (27) is dimensioned so that it is at least sectionally contacted when penetrating the passages (37) on its top side by the first clamping element (11) and on its bottom side by the valve plate (7), in order to transmit clamping force from the second clamping element (29) to the valve plate (7).

* * * * *